United States Patent [19]

Porter

[11] 4,390,005

[45] Jun. 28, 1983

[54] FAN ACCESSORY FOR HEATER

[76] Inventor: Donald G. Porter, 8620 Wilkinson Blvd., Charlotte, N.C. 28208

[21] Appl. No.: 365,594

[22] Filed: Apr. 5, 1982

[51] Int. Cl.[3] ..... F24H 3/02

[52] U.S. Cl. ..... 126/110 B; 165/124

[58] Field of Search ..... 165/123, 124; 126/110 R, 110 A, 110 B, 110 C, 110 D

[56] References Cited

U.S. PATENT DOCUMENTS

| | | | |
|---|---|---|---|
| 2,021,462 | 11/1935 | Panaro | 126/110 B |
| 2,173,073 | 9/1939 | Pierson | 126/110 B |
| 2,479,906 | 8/1949 | Cole | 126/110 B |
| 2,553,278 | 5/1951 | Rogant | 126/110 B |
| 2,633,070 | 3/1953 | Gillham | 165/124 |
| 2,740,579 | 4/1956 | Welsh | 126/110 B |
| 2,741,243 | 4/1956 | Jenson | 126/110 B |
| 2,808,823 | 10/1957 | Snyder | 126/110 B |
| 2,834,279 | 5/1958 | Thompson | 126/110 B |
| 2,904,317 | 9/1959 | Copeland | 165/124 |
| 3,171,399 | 3/1965 | Kirgan | 126/110 B |
| 3,246,643 | 4/1966 | Stark | 126/110 B |
| 3,324,938 | 6/1967 | Berkoff | 126/110 B |
| 3,358,670 | 12/1967 | Osborne | 126/110 B |
| 3,384,070 | 5/1968 | Castello | 126/110 B |

*Primary Examiner*—Daniel J. O'Connor

*Attorney, Agent, or Firm*—Bell, Seltzer, Park & Gibson

[57] ABSTRACT

A fan accessory for recovering heated air generated by a heater in which ambient and heated air are induced to enter inlets into a housing, are blended within the housing, and are directed from the housing into an area to be heated.

2 Claims, 7 Drawing Figures

FAN ACCESSORY FOR HEATER

FIELD AND BACKGROUND OF INVENTION

This invention relates to a fan accessory for use with heaters.

As energy costs have risen, alternatives have been sought for heating space occupied for business or residential reasons. One alternative which has found acceptance is the use of relatively small space heaters, many of which are fueled by liquid hydrocarbon fuels such as kerosene. As typically used, such heaters provide significant quantities of heat at relatively confined areas and at costs which are deemed more acceptable than the costs of operating a central heating system.

Such kerosene fueled heaters are, at the time of this writing, available from a number of sources and typically are of either radiant heating or convective heating types. In either instance, combustion of kerosene fuel generates heat emitted from the heater either primarily as radiant energy or primarily as heated air but, in any event, at least in part by convective heating. Particularly with radiant heaters of the type described, convectively heated air is not efficiently utilized and, as a result, the full recovery of heat possible from the fuel provided is never accomplished.

BRIEF DESCRIPTION OF INVENTION

With the foregoing discussion in mind, it is an object of the present invention to enhance the recovery of heat from a heater of the general type described. In realizing this object of the present invention, a fan accessory is provided for recovering heated air generated by the heater. The heated air is recovered by inducing flows of air which enhance the transfer of heat from the heated elements of the heater.

Yet a further object of the present invention is to provide a fan accessory which may be readily mounted on or demounted from a heater of the general type described. By the provision of such an accessory, heating demands which may vary from time to time may be accommodated by using or not using the fan accessory, thereby broadening the usefulness of the heater.

BRIEF DESCRIPTION OF FIGURES

Some of the objects of the invention having been stated, other objects will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
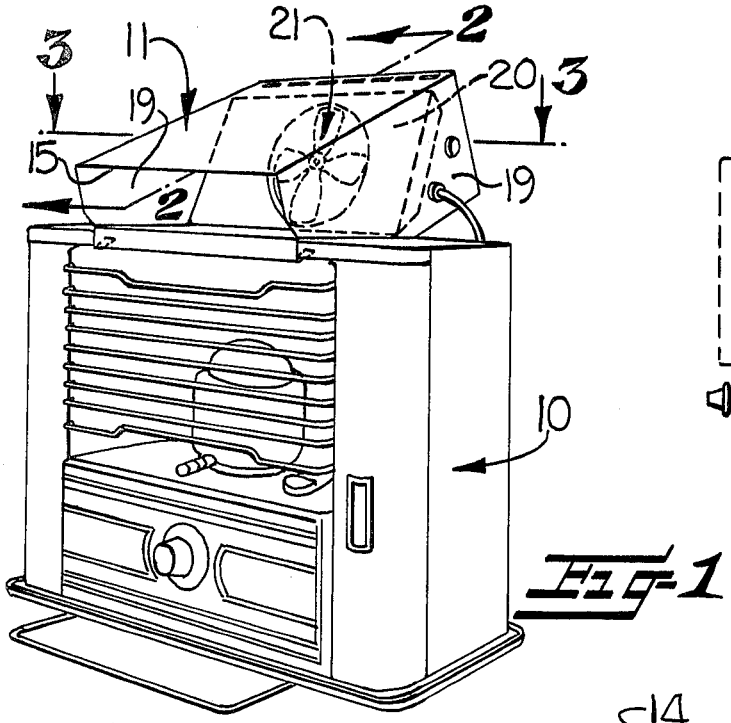
FIG. 1 is a perspective view of a heater and fan accessory in accordance with the present invention.

Referring now more particularly to FIG. 1, a heater of a known type is there generally indicated at 10. In the form shown, the heater 10 is of the kerosene fueled radiant type, housed in a generally rectangular housing, and is representative of a large number of heaters available from a variety of sources. As is known to persons of appropriate skill in the applicable arts, such heaters conventionally include a combustion chamber and have, in an upper surface of the housing, vent openings through which air heated by the heater exits. Where the heater 10 is one designed primarily for radiant heating, the air flow is relatively small. Where the heater 10 is of a type primarily designed for convective heating, the air flow may be somewhat larger. The present invention contemplates that the fan accessory now to be described may be used with any of a large number of types of such heaters.

Figure 3:
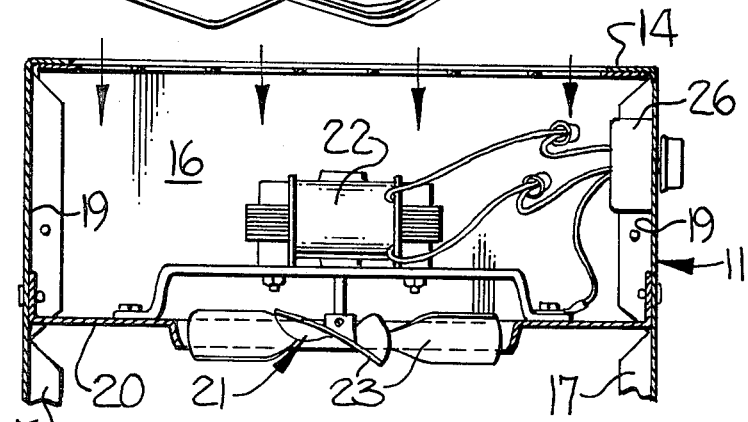
FIG. 3 is a partially sectional plan view taken generally along the line 3—3 in FIG. 1.
Figure 5:
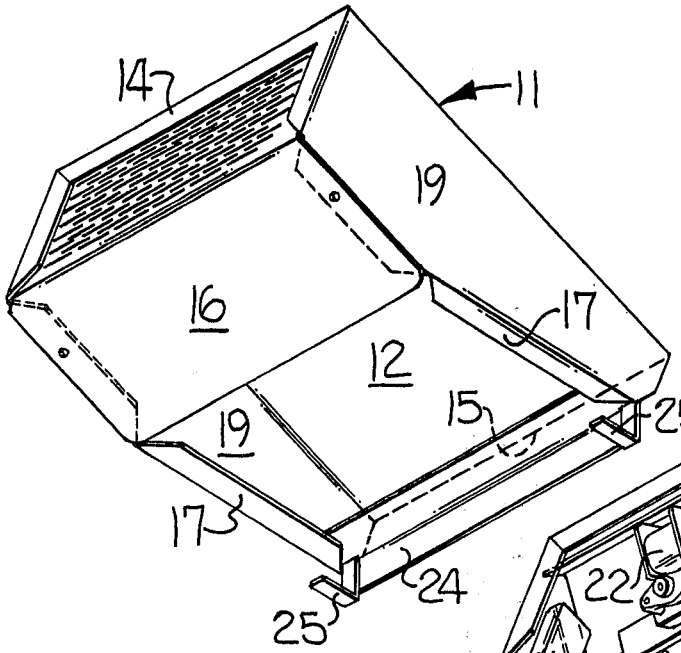
FIG. 5 is a perspective view, from below, of the fan accessory of FIGS. 1 through 3.
Figure 6:
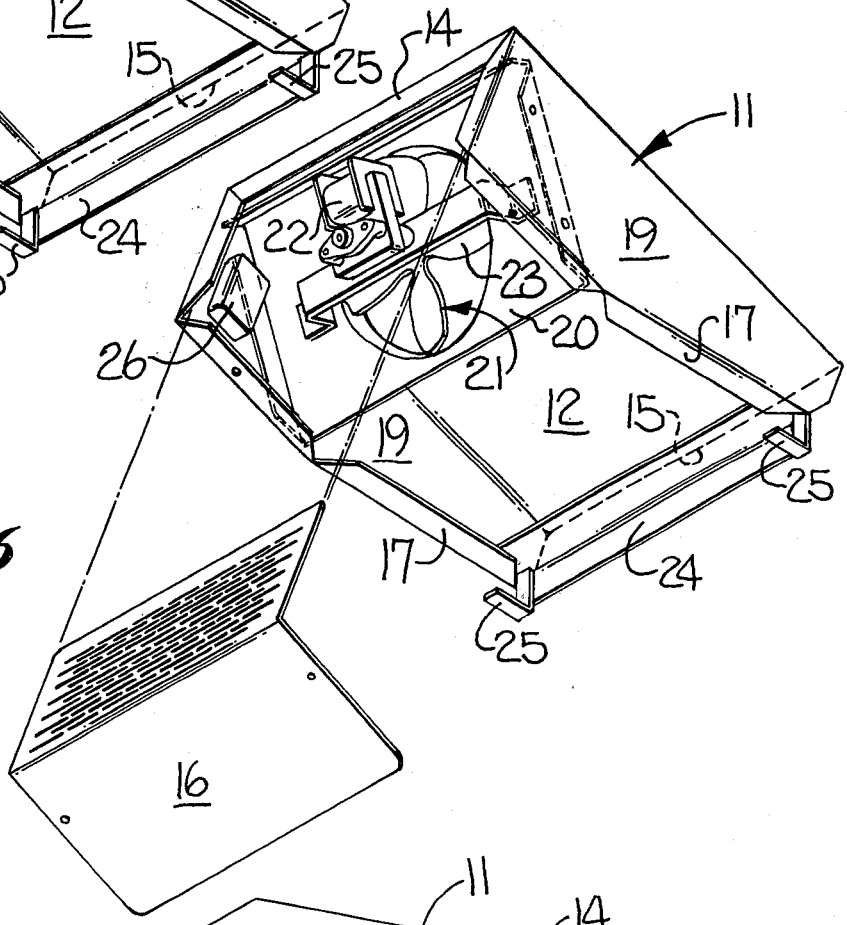
FIG. 6 is a partly exploded view similar to FIG. 5.
Figure 7:
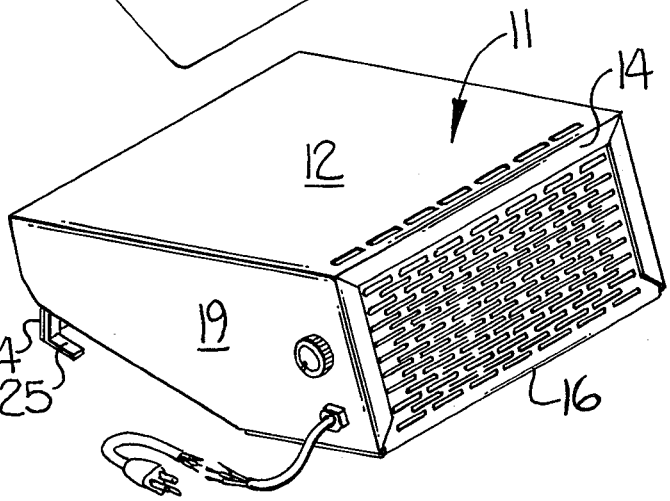
FIG. 7 is a perspective view, from above and behind, of the fan accessory of FIGS. 1 through 3, 5 and 6.

The fan accessory of the present invention comprises housing means, generally indicated at 11, for directing air flow. The housing means 11 for the fan accessory of the present invention has an upper wall 12, and a rear wall 14 (formed by a series of folded lips in the specific embodiment illustrated) defining a heated air inlet. The housing 11 additionally has a front portion, indicated at 15, defining a blended air outlet. In the form illustrated, the housing has a closure plate 16 (FIGS. 5 and 6) which engages the rear wall 14 and cooperates therewith in closing a portion of the housing which is adjacent to a fan means described hereinafter and mounted within the housing. The plate 16 has a perforated wall (FIGS. 5 through 7) through which air may enter the ambient air inlet defined by the rear wall, as suggested by arrows in FIGS. 2 and 3. The housing also has a lower wall 17 (formed by folded lips) and side walls 19. The side walls form with the upper wall 12, rear wall 14, front portion 15 and lower wall a prism having a pentagonal cross-section in a plane perpendicular to the upper and rear walls. The upper wall 12 and lower wall 17 are convergingly arranged relative to each other in the direction of air flow which causes the air flow to more rapidly move through the housing.

Within the housing 11 is a transverse wall 20 which provides for the mounting of the fan means 21. The fan means 21 includes an appropriate motive means such as an electrical motor 22 and a fan blade 23 driven by the motor 22. Preferably, the fan blade 23 is positioned within a circular opening in the wall 20, so as to partially shroud the fan and improve the air handling characteristics thereof. The fan induces ambient air and heated air to enter the inlets and flow through the housing. Additionally, the fan causes the ambient and heated air to blend together within the housing and then directs the blended air to flow from the outlet, all as generally indicated by arrows in FIG. 2. It will be noted that the fan means is angled or tilted in such a manner as to impinge the air against the upper wall 12 and produce the efforts described.

Figure 2:
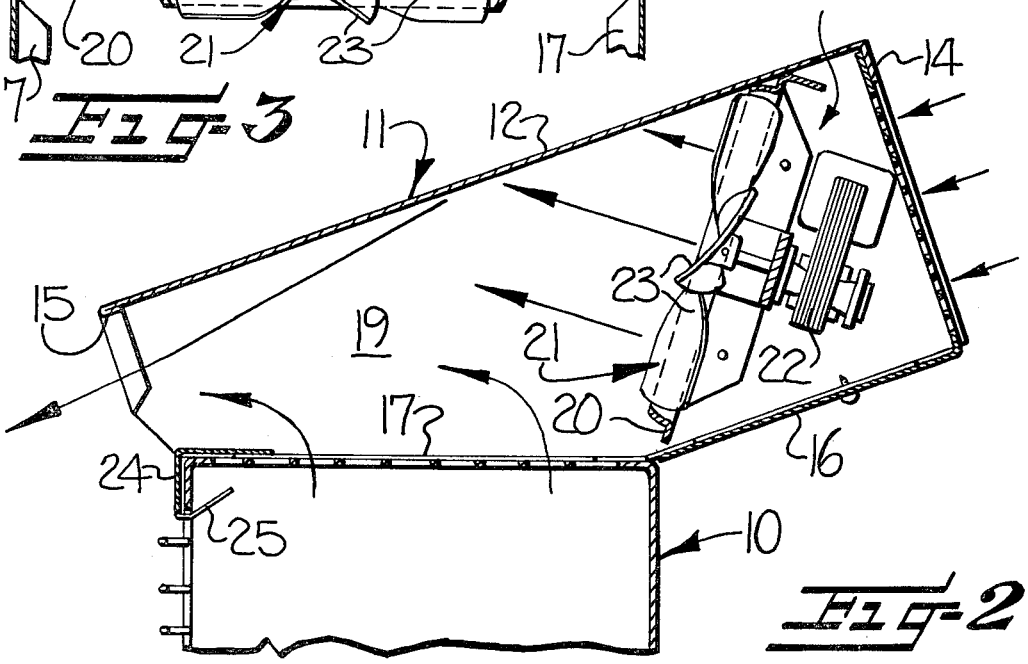
FIG. 2 is an enlarged sectional elevational view, taken generally along the line 2—2, of the fan accessory and a portion of the heater of FIG. 1.

In order to accommodate the inducement of flow of heated air and the blending as described hereinabove, the lower wall of the housing means 11 defines a heated air inlet. Additionally, heater engaging means are provided on the housing means for positioning the fan accessory in operative association with a heater. In the specific form here illustrated, the heater engaging means takes the form of a depending lip 24 with a pair of legs 25 adapted to clip onto an upper surface of the heater 10 (FIGS. 1 and 2). When so positioned, the heated air inlet defined by the lower wall overlies the heated air vent openings conventionally provided at the upper surface of the heater 10.

Figure 4:
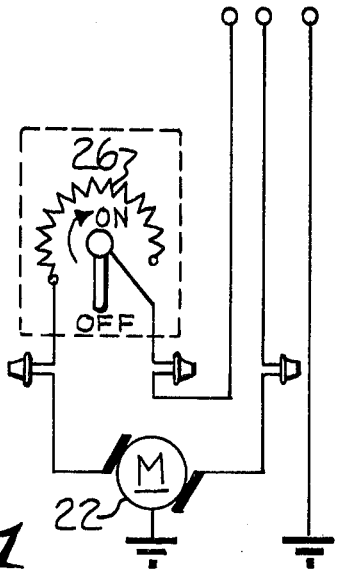
FIG. 4 is a schematic representation of an electrical circuit used in the fan accessory of FIGS. 1 through 3.

In order to provide for adjustment of the heating effect accomplished and the recovery of heated air generated by the heater 10, it is preferred that the electrical motor 22 driving the fan blade 23 be supplied through a variable speed control such as a rheostat 26 (FIG. 4). With such a variable speed control, the velocities of air flow may be adjusted in such a manner as to accomplish the inducement and blending of flow described hereinabove. Such inducement and blending of flow is further aided by an inclination of the interior wall 20 (as illustrated particularly in FIG. 2), which results in the air flows through the housing means being directed into impinging engagement with the upper wall 12 of the housing means 11 at an angle in the particular manner as indicated.

In use, the fan accessory of the present invention may be associated with a heater of the general type described when it is desirable to improve the heating efficiency of such a heater by recovering heated air generated by the heater. In such use, the fan accessory is positioned with the heater engaging means as indicated in FIGS. 1 and 2, and the speed of the fan means is adjusted to induce, blend and deliver air flows as described.

In the drawings and specification, there has been set forth a preferred embodiment of the invention, and although specific terms are employed, they are used in a generic and descriptive sense only and not for purposes of limitation.

That which is claimed is:

1. Apparatus for heating occupied space such as a room within a building and comprising:

liquid hydrocarbon fueled heater means for generating heat, and a fan accessory for recovering heated air generated by said heater means, said fan accessory comprising:

housing means for directing air flow and having an upper wall, a rear wall defining an ambient air inlet, a lower wall defining a heated air inlet, and a front portion defining an air outlet for ambient and heated air, the upper and lower walls of said housing means being convergingly arranged relative to each other toward said air outlet in the direction of air flow to cause the air flow through said outlet to move more rapidly therethrough, fan means mounted within said housing means for inducing ambient and heated air to enter said inlets and flow through said housing means and out of said air outlet, said fan means comprising variable speed control means for varying the rate of flow of ambient and heated air through said inlets and out of said outlet, said fan means being angularly mounted within said housing means so as to cause the air flow through the housing to be impingingly engaged with the upper wall of the housing, and heater engaging means on said housing means for positioning the housing to receive through said heated air inlet heated air generated by said heater means.

2. A fan accessory for recovering heated air generated by a heater and comprising:

housing means for directing air flow and having an upper wall, a rear wall defining an ambient air inlet, a lower wall defining a heated air inlet, and a front portion defining an air outlet for ambient and heated air, the upper and lower walls of said housing means being convergingly arranged relative to each other toward said air outlet in the direction of air flow to cause the air flow through said outlet to move more rapidly therethrough, fan means mounted within said housing means for inducing ambient and heated air to enter said inlets and flow through said housing means and out of said air outlet, said fan means comprising variable speed control means for varying the rate of flow of ambient and heated air through said inlets and out of said outlet, said fan means being angularly mounted within said housing means so as to cause the air flow through the housing to be impingingly engaged with the upper wall of the housing, and heater engaging means on said housing means for positioning the housing to receive through said heated air inlet heated air generated by a heater.

* * * * *